US006915821B2

(12) United States Patent
Ooyauchi et al.

(10) Patent No.: US 6,915,821 B2
(45) Date of Patent: Jul. 12, 2005

(54) METAL TUBE AND ITS PRODUCTION METHOD

(75) Inventors: Tetsuya Ooyauchi, Kanagawa (JP); Masayuki Okano, Tokyo (JP)

(73) Assignees: Terumo Kabushiki Kaisha, Tokyo (JP); Okano Kogyo Co., Ltd., Tokyo (JP)

( * ) Notice: Subject to any disclaimer, the term of this patent is extended or adjusted under 35 U.S.C. 154(b) by 29 days.

(21) Appl. No.: 10/283,291

(22) Filed: Oct. 30, 2002

(65) Prior Publication Data

US 2003/0089414 A1 May 15, 2003

(30) Foreign Application Priority Data

Oct. 31, 2001 (JP) ..... 2001-334143

(51) Int. Cl.[7] ..... F16L 9/00; B21D 51/10

(52) U.S. Cl. ..... 138/177; 138/DIG. 11; 72/370.14; 72/370.15; 428/586; 428/600; 205/73

(58) Field of Search ..... 138/177, 178, 138/DIG. 11, 143; 205/640, 131, 73; 204/272; 72/370.14, 370.15; 428/577, 586, 600

(56) References Cited

U.S. PATENT DOCUMENTS 2,855,929 A * 10/1958 Hein, Jr. ..... 604/411
3,173,200 A * 3/1965 Dunmire et al. ..... 29/414
4,672,734 A * 6/1987 Kawada et al. ..... 29/517
4,785,868 A 11/1988 Koenig, Jr.
5,294,309 A * 3/1994 Seimiya et al. ..... 205/660
5,640,874 A 6/1997 Vecsey
5,842,086 A * 11/1998 Honma et al. ..... 399/159
6,337,459 B1 * 1/2002 Terwijn et al. ..... 219/121.47
6,579,628 B2 * 6/2003 Takeuchi et al. ..... 428/667

FOREIGN PATENT DOCUMENTS

EP 0 180 125 A2 5/1986
EP 0 452 501 A1 10/1991
EP 1308221 A2 * 5/2003 ..... B21C/37/06
JP 03284264 A * 12/1991 ..... A61M/5/32
JP 20041053 A2 * 6/2002
WO WO 98/37853 A1 2/1998

* cited by examiner

*Primary Examiner*—Patrick Brinson
(74) *Attorney, Agent, or Firm*—Burns, Doane, Swecker & Mathis, L.L.P.

(57) ABSTRACT

A small diameter metal tube whose inner surface is smooth and its production method are provided. The metal tube has an inner diameter of up to 1.0 mm and its inner surface has a maximum height difference (Rf) in the surface roughness of up to 3 $\mu$m.

2 Claims, 4 Drawing Sheets

METAL TUBE AND ITS PRODUCTION METHOD

BACKGROUND OF THE INVENTION

1. Field of the Invention

This invention relates to a metal tube and its production method. To be more specific, this invention relates to a small diameter metal tube whose inner surface is smooth and which can be used for a pin, injection needle, connector, electron gun for TV liquid crystal, and the like and its production method.

2. Prior Art

Metal tubes of small diameter such as those having, for example, an outer diameter of up to 1.3 mm and used for a medical pin, injection needle, connector, electron gun for TV, or the like are typically produced by curling a metal thin plate having a thickness of up to 0.2 mm simultaneously with the drawing, welding the abutting edges of the thin plate just before its entrance into a drawing die, drawing the welded member through the drawing die to form a tube having an outer diameter of about 4 to 6 mm, and repeating the drawing process to thereby produce a tube product having a desired outer diameter. FIG. 3 shows typical process of drawing. In FIG. 3, a metal tube 1 which has been formed to an outer diameter of about 4 to 6 mm is drawn through a die 2 having a die bore of smaller cross section to thereby reduce the outer diameter and produce a tube whose cross section is identical with the bore of the die and which has an outer diameter of for example up to 1.3 mm. In the drawing, a plug 3 for defining the inner diameter is inserted in the tube 1 to thereby prevent the occurrence of creases on the inner surface of the tube 1 during the drawing process.

However, when the diameter of the tube 1 becomes reduced after repeated drawings, insertion of the plug 3 in the tube 1 becomes impossible, and such drawing with no plug 3 is inevitable. When the tube 1 is drawn with no plug 3 inserted in the tube 1, the inner surface of the tube 1 becomes creased and the inner surface will suffer from an increased surface roughness which results in the increase in the resistance of a fluid passing through the tube 1. Increase in the surface roughness also results in the increase in the surface area which invites adhesion of dirt and foreign matters. This is a serious problem when the tube is used for a medical application where hygiene is of serious interest. In spite of such situation, there has so far been no small diameter tube which is free from the problem of the rough inner surface.

On the other hand, demand for tubes of smaller diameter exists actually. It is desirable for a person who has a routine work of insertion of an injection needle into the skin, such as a patient suffering from diabetes who must inject insulin on a regular basis to have as little pain as possible when the needle is inserted. The pain caused by the insertion of the needle is associated with the magnitude of the resistance in its insertion. It has been sought to develop an injection needle having a reduced resistance in its insertion, in other words, an injection needle of smaller diameter.

SUMMARY OF THE INVENTION

An object of the present invention is to obviate the problems of the prior art technology as described above by providing a metal tube whose inner surface is smooth in spite of its small diameter.

Another object of the invention is to provide its production method.

In order to attain the objects described above, the present invention provides a metal tube having an inner surface and outer surface whose inner surface has a maximum height difference (Rf) in the surface roughness of up to 3 $\mu$m and which has an inner diameter of up to 1.0 mm.

The present invention also provides a metal tube which has an inner diameter of up to 1 mm and which is produced by press forming a metal thin plate.

The thin plate used for press forming has preferably a maximum height difference (Rf) in the surface roughness of up to 3 $\mu$m.

The present invention further provides a method for producing a metal tube, comprising the steps of: blanking a plate member having a development shape of the metal tube from a metal thin plate such that the plate member is left partly tied to the metal thin plate; press forming the plate member into a tube member; and cutting parts tying the metal thin plate to the plate member to produce the metal tube having an inner diameter of up to 1.0 mm.

In the method of the present invention for producing the metal tube, the tube member obtained by press forming the plate member is preferably welded along its seam.

BRIEF DESCRIPTION OF THE DRAWINGS

FIG. 1B being a view when the plate member has been curled by press forming.

FIG. 2D showing the plate member which has been press formed into a tube.

DETAILED DESCRIPTION OF THE PREFERRED EMBODIMENTS

Figure 1A:
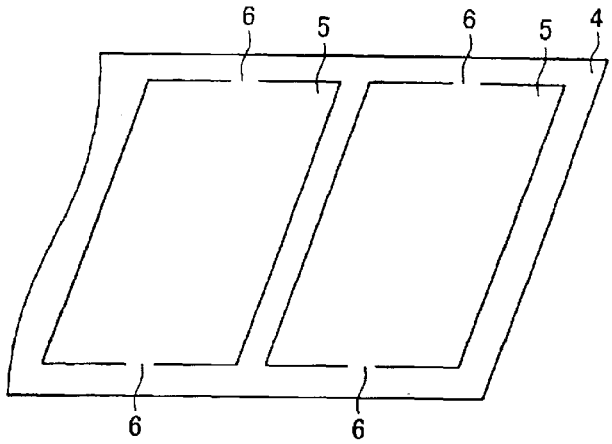
FIGS. 1A and 1B schematically show the tube production according to the method of the invention, FIG. 1A being a view when a plate member having a development shape of a tube has been blanked from a metal thin plate.

Next, the metal tube and the method for producing the metal tube according to the present invention are described by referring to the accompanying drawings.

The metal tube of the present invention is not limited in any particular way, if its inner surface has a maximum height difference (Rf) in the surface roughness of up to 3 $\mu$m and its inner diameter is up to 1.0 mm.

The profile of the tube is usually in the shape of a straight tube but may be in another shape, for example, in the shape of a bent tube.

The maximum height difference (Rf) in the surface roughness is also referred to as $R_y$ (maximum height, $R_{max}$) according to JIS-B-0601-1994 and means a height from the highest point to the lowest point with respect to an average line of a reference length. In the present invention, the tube inner surface has a maximum height difference (Rf) in the surface roughness of up to 3 $\mu$m, preferably up to 2 $\mu$m, and more preferably up to 1 $\mu$m. When the tube inner surface has an Rf within the above-specified range, the entire inner surface of the tube will be smooth with no major scratch, and the tube will be quite suitable for use as a medical device.

The tube typically has an outer diameter of up to 1.3 mm, preferably up to 1 mm, and more preferably up to 0.4 mm. When the outer diameter of the tube is within such range, the tube used as an injection needle will experience reduced resistance in its insertion into the skin, and pain associated with the injection will be reduced.

The tube has an inner diameter of up to 1.0 mm, preferably up to 0.8 mm, and more preferably up to 0.3 mm. When the tube has an inner diameter within such range, the tube will enjoy sufficient strength required for the tube when the tube has an outer diameter within the above-specified range.

The metal constituting the tube is not limited to any particular metal, and the metals which may be used include a steel material such as stainless steel, a nonferrous structural material such as aluminum, copper, or titanium, a heat-resistant material such as nickel, cobalt, or molybdenum, a low melting point metal material such as lead or tin, a noble metal material such as gold, silver or platinum, and an alloy thereof.

The tube is not limited for its length. Since the tube of the present invention has an outer diameter of up to 1.3 mm and an inner diameter of up to 1.0 mm, the tube has inevitably a thin wall thickness. Therefore, the length of the tube must be appropriately selected in accordance with the strength required for the tube. For example, when the tube is used for an injection needle, the tube having a diameter corresponding to the injection needle of gage 25 to 33 should have a Vickers hardness of 200.

The tube described above may be produced by any method if the requirements described above can be satisfied. The tube of the present invention is preferably produced from a metal thin plate by press forming.

The metal tube of the present invention also includes a tube whose inner diameter is up to 1.0 mm and which is produced from a metal thin plate by the press forming of the present invention. In this case, Rf may not fall within the above-specified range.

FIGS. 1A, 1B, 2C and 2D illustrate a typical procedure of producing the metal tube according to the method of the present invention. It is to be noted, however, that the procedure shown by the drawings are presented for ease of understanding on the method of the present invention, and the method of the present invention is by no means limited by such illustration.

Figure 1B:
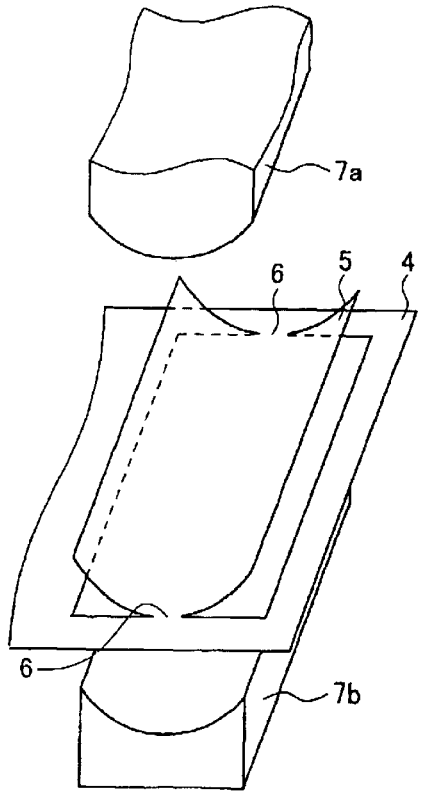
Figure 2C:
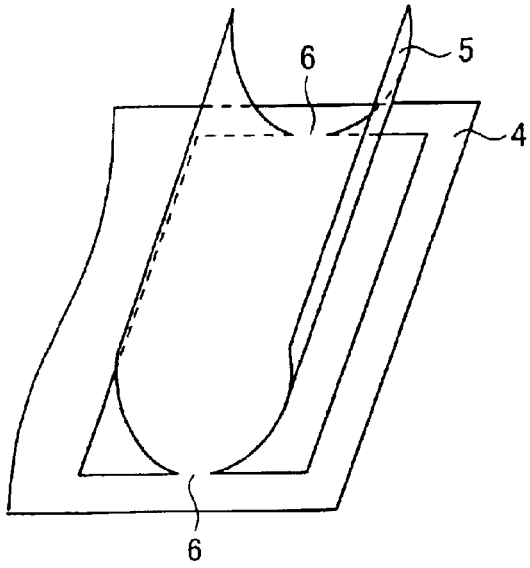
FIGS. 2C and 2D schematically show the tube production according to the method of the invention, FIG. 2C showing the plate member which has been press formed into U shape.
Figure 2D:
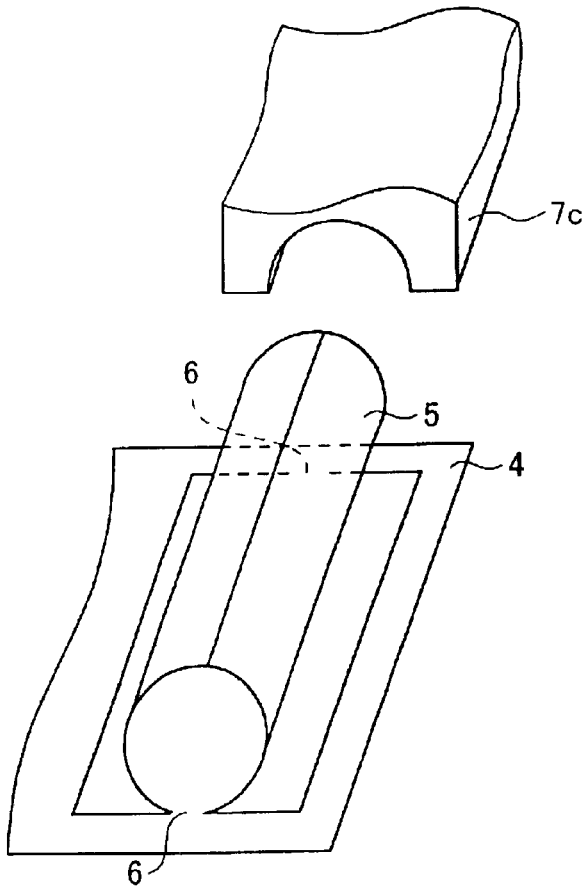
Figure 3:
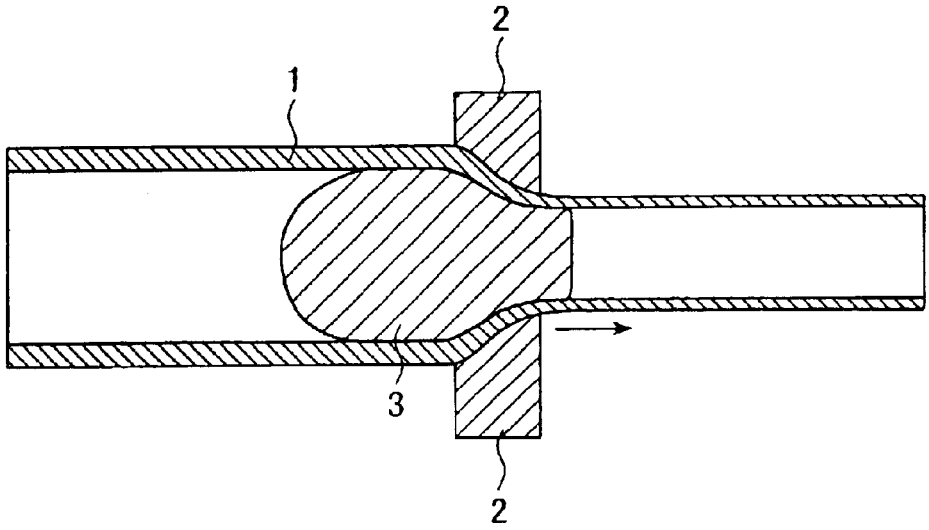
FIG. 3 PRIOR ART
FIG. 3 is a view showing the step of drawing in the conventional tube production process.

In the method of the present invention, a plate member 5 having a development shape of a tube is blanked from a metal thin plate 4 having a thickness of up to 0.25 mm as shown in FIG. 1A. In this step, it is important that the plate member 5 is not completely blanked out of the metal thin plate 4 but is partly left tied to the thin plate 4. In FIG. 1A, central parts 6 in the shorter sides of the plate member 5 are left uncut to form tie portions 6 which tie the plate member 5 to the metal thin plate 4. Next, the plate member 5 is press formed as shown in FIG. 1B from both of the upper and lower sides using upper and lower mold halves 7*a* and 7*b*. In FIG. 1B, the plate member 5 is press formed into a curved shape about the axis extending through the tie portions 6 by the convex upper half 7*a* and the concave lower half 7*b*. FIG. 2C shows the plate member which has been press formed to some degree. In FIG. 2C, the plate member 5 has been curled into U-shape. Such curling to the U-shape may be accomplished either by the press forming using the upper and lower mold halves 7*a* and 7*b* shown in FIG. 1B, or by the press forming using a mold having a different shape. The plate member which has been curled into the U-shape is further formed into a tube as shown in FIG. 2D by using a concave upper mold 7*c*. As will be easily understood by those skilled in the art, the procedure of press forming into the tube as shown in FIG. 2D may include several press forming steps using molds of different configurations.

The seam of the tube formed by the press forming should be fluid tightly joined in some applications, for example, when the tube is used by passing a fluid therethrough as in the case of injection needle. The seam may be joined by using an adhesive. It is, however, preferable to weld the tube along its seam since the tube is made of a metal and is as thin as 1.3 mm in its outer diameter. The welding of the seam is preferably accomplished by melting the matrix of the tube, for example, by laser welding such as carbon dioxide laser welding, YAG laser welding, eximer laser welding, or the like among which the carbon dioxide laser welding and the YAG laser welding being particularly preferred in view of their wide availability, low cost, and adaptability to micromachining.

The tube of the present invention can be obtained by cutting the tie portions between the thin plate and the plate member after the welding of the seam. When the tube is not welded, the tube can be obtained by cutting the tie portions between the thin plate and the plate member after formation of the tube by the press forming of the plate member.

The thus produced tube may be further processed depending on the intended use of the tube. For example, when the tube is to be used as an injection needle, the tube should be further processed, for example, to thereby provide the tube with an edge by a suitable conventional method.

According to the method of the present invention which does not require the drawing process, a tube whose inner surface has a Rf of up to 3 $\mu$m can be produced in a high yield, and a long drawing machine is not necessary.

A plurality of tubes can be produced from one thin plate at a time by using a long thin plate having a width corresponding to a length of a tube and small diameter tubes whose inner surfaces are smooth as well as the outer surface can be produced at a lower cost.

EXAMPLE

Next, the present invention is described in further detail by referring to the following Example.

Example 1

Figure 4A:
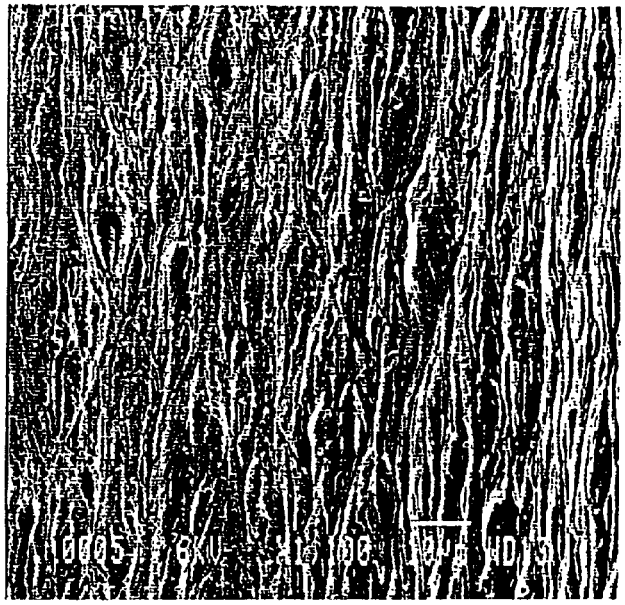
FIG. 4A PRIOR ART
FIG. 4A is a micrograph of the inner surface of a tube in Comparative Example taken at 1100× magnification.
Figure 4B:
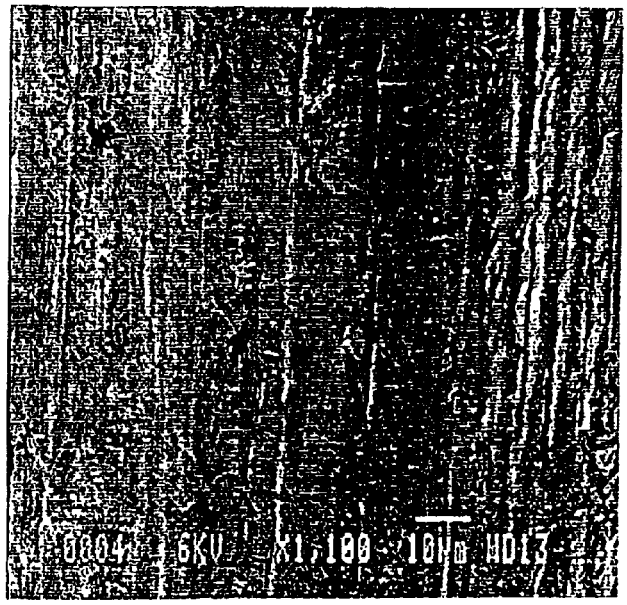
FIG. 4B is a micrograph of the inner surface of a tube in Example 1 taken at 1100× magnification.

Tubes (tube 1, 2) each having an outer diameter of 0.35 mm, an inner diameter of 0.25 mm and a length of 18 mm were produced by press forming a thin plate of stainless steel (SUS304) having a thickness of 0.05 mm according to the procedure shown in FIGS. 1A, 1B, 2C and 2D. The tubes were cut parallel with the axial direction and the surface roughness of the inner surface was measured according to JIS B0601 by using a scanning type laser microscope 1LM21 (Laser Tec. Co., Ltd.) to determine the maximum height difference ($Rf=R_{max}$). Rf measurements were shown in Table 1. In order to confirm the state on the inner surface of a cut tube, a micrograph was taken using 1LM21. FIG. 4B shows a micrograph of the inner surface of the tube in Example 1.

Comparative Example

A thin plate (SUS304) having a thickness of 0.17 mm was subjected to a conventional method utilizing a drawing process to thereby produce tubes (tube 1, 2) whose material and dimensions are the same as those in Example 1 (outer diameter: 0.35 mm; inner diameter: 0.25 mm; length: 18 mm). The inner surfaces of the resulting tubes were subjected to the Rf measurement as in Example 1. The Rf measurements were shown in Table 1. A micrograph of the inner surface of a tube in Comparative Example was also taken. FIG. 4A shows a micrograph of the inner surface of the tube in Comparative Example.

TABLE 1

| | Example 1 | Comparative Example |
|---|---|---|
| Outer diameter (mm) | 0.35 | 0.35 |
| Inner diameter (mm) | 0.25 | 0.25 |
| Length (mm) | 18 | 18 |
| $R_{max}$ ($\mu$m) | | |
| tube 1 | 0.86 | 5.92 |
| tube 2 | 0.58 | 8.75 |

As is clear from Table 1, it can be confirmed in the tubes produced by the method of the present invention that their inner surfaces have each a smaller Rf and are kept smooth as compared with the tubes in Comparative Example produced by the conventional method.

Although the metal tube of the present invention has a small diameter, the inner surface thereof is kept smooth, and the resistance of a fluid passing through the tube is low. Dirt and foreign matters are less prone to adhere thereto. Therefore, the metal tube of the present invention can be suitably used in various applications requiring small diameter tubes, for example by forming into an injection needle.

In the metal tube production method according to the present invention, press forming is only necessary to obtain a tube having desired dimensions. A tube which has no creases on its inner surface as in a conventional production method utilizing the drawing and whose inner surface is kept smooth can be obtained. According to the metal tube production method of the present invention, the tube described above can be produced at a low cost.

What is claimed is:

1. A metal tube having an inner diameter of up to 1.0 mm produced by press forming a thin metal plate whose inner surface has a maximum height difference (Rf) in the surface roughness of up to 3 $\mu$m and, wherein after press forming, the tube has an inner surface having a maximum height difference (Rf) in the surface roughness of up to 3 $\mu$m.

2. The metal tube according to claim 1 wherein the tube is produced by the method comprising the steps of:

blanking a plate member having a development shape of the metal tube from a thin metal plate such that said plate member may be left partly tied at two points to said thin metal plate; and press forming said plate member into a tube member whose longitudinal axis is the line between the two points tied to the thin metal plate.

* * * * *